US010446123B2

(12) United States Patent
Wang et al.

(10) Patent No.: US 10,446,123 B2
(45) Date of Patent: Oct. 15, 2019

(54) INTUITIVE MUSIC VISUALIZATION USING EFFICIENT STRUCTURAL SEGMENTATION

(71) Applicant: ADOBE INC., San Jose, CA (US)

(72) Inventors: Cheng-i Wang, San Diego, CA (US); Gautham Mysore, San Francisco, CA (US)

(73) Assignee: ADOBE INC., San Jose, CA (US)

( * ) Notice: Subject to any disclaimer, the term of this patent is extended or adjusted under 35 U.S.C. 154(b) by 0 days.

(21) Appl. No.: 16/057,674

(22) Filed: Aug. 7, 2018

(65) Prior Publication Data

US 2018/0374459 A1 Dec. 27, 2018

Related U.S. Application Data

(63) Continuation of application No. 14/948,695, filed on Nov. 23, 2015, now Pat. No. 10,074,350.

(51) Int. Cl.

| | |
|---|---|
| ***A63H 5/00*** | (2006.01) |
| ***G04B 13/00*** | (2006.01) |
| ***G10G 1/00*** | (2006.01) |

(52) U.S. Cl.

CPC ..... *G10G 1/00* (2013.01); *G10H 2210/041* (2013.01); *G10H 2210/061* (2013.01); *G10H 2210/076* (2013.01); *G10H 2220/131* (2013.01); *G10H 2250/015* (2013.01); *G10H 2250/135* (2013.01)

(58) Field of Classification Search

CPC ..... G10G 1/00; G10H 2250/135; G10H 2210/076; G10H 2220/131; G10H 2210/041; G10H 2250/015; G10H 2210/061

USPC ..... 84/609

See application file for complete search history.

(56) References Cited

U.S. PATENT DOCUMENTS

| | | | |
|---|---|---|---|
| 6,225,546 | B1 | 5/2001 | Kraft et al. |
| 7,732,697 | B1 | 6/2010 | Wieder |
| 8,044,290 | B2 | 10/2011 | Kwon et al. |
| 8,283,548 | B2 | 10/2012 | Oertl et al. |
| 2008/0209484 | A1 | 8/2008 | Xu |
| 2011/0112672 | A1 | 5/2011 | Brown et al. |
| 2012/0312145 | A1 | 12/2012 | Kellett et al. |

(Continued)

OTHER PUBLICATIONS

Bello, J. P., & Pickens, J. (Sep. 2005). A Robust Mid-Level Representation for Harmonic Content in Music Signals. In ISMIR (vol. 5, pp. 304-311).

(Continued)

*Primary Examiner* — Jeffrey Donels

(74) *Attorney, Agent, or Firm* — Shook, Hardy & Bacon, L.L.P.

(57) ABSTRACT

Embodiments of the present invention relate to automatically identifying structures of a music stream. A segment structure may be generated that visually indicates repeating segments of a music stream. To generate a segment structure, a feature that corresponds to a music attribute from a waveform corresponding to the music stream is extracted from a waveform, such as an input signal. Utilizing a signal segmentation algorithm, such as a Variable Markov Oracle (VMO) algorithm, a symbolized signal, such as a VMO structure, is generated. From the symbolized signal, a matrix is generated. The matrix may be, for instance, a VMO-SSM. A segment structure is then generated from the matrix. The segment structure illustrates a segmentation of the music stream and the segments that are repetitive.

20 Claims, 11 Drawing Sheets

(56) References Cited

U.S. PATENT DOCUMENTS

| | | | |
|---|---|---|---|
| 2013/0275421 | A1 | 10/2013 | Resch et al. |
| 2014/0330556 | A1 | 11/2014 | Resch et al. |
| 2014/0338515 | A1 | 11/2014 | Sheffer et al. |

OTHER PUBLICATIONS

Brown, J. C., & Puckette, M. S. (1992). An efficient algorithm for the calculation of a constant Q transform. The Journal of the Acoustical Society of America, 92(5), 2698-2701.

Cont, A., Dubnov, S., & Assayag, G. (2007). Guidage: A fast audio query guided assemblage. In Proceedings of International Computer Music Conference (ICMC). ICMA.

Dubnov, S., Assayag, G., & Cont, A. (Sep. 2011). Audio oracle analysis of musical information rate. In Semantic Computing (ICSC), 2011 Fifth IEEE International Conference on (pp. 567-571). IEEE.

Ehmann, A. F., Bay, M., Downie, J. S., Fujinaga, I., & De Roure, D. (Oct. 2011). Music Structure Segmentation Algorithm Evaluation: Expanding on MIREX 2010 Analyses and Datasets. In ISMIR (pp. 561-566).

Grohganz, H., Clausen, M., Jiang, N., & Müller, M. (2013). Converting Path Structures Into Block Structures Using Eigenvalue Decompositions of Self-Similarity Matrices. In ISMIR (pp. 209-214).

Kanungo, T., Mount, D. M., Netanyahu, N. S., Piatko, C. D., Silverman, R., & Wu, A. Y. (2002). An efficient k-means clustering algorithm: Analysis and implementation. IEEE transactions on pattern analysis and machine intelligence, 24 (7), 881-892.

Lefebvre, A., & Lecroq, T. (2002). Compror: on-line lossless data compression with a factor oracle. Information Processing Letters, 83(1), 1-6.

Lefebvre, A., Lecroq, T., & Alexandre, J. (2003). An improved algorithm for finding longest repeats with a modified factor oracle. Journal of Automata, Languages and Combinatorics, 8(4), 647-657.

Li, J. (2011). Agglomerative connectivity constrained clustering for image segmentation. Statistical Analysis and Data Mining: The ASA Data Science Journal, 4(1), 84-99.

McFee, B., & Ellis, D. (2014). Analyzing Song Structure with Spectral Clustering. In ISMIR (pp. 405-410).

Mermelstein, P. (1976). Distance measures for speech recognition, psychological and instrumental. Pattern recognition and artificial intelligence, 116, 374-388.

Nieto, O., & Jehan, T. (May 2013). Convex non-negative matrix factorization for automatic music structure identification. In Acoustics, Speech and Signal Processing (ICASSP), 2013 IEEE International Conference on (pp. 236-240). IEEE.

Paulus, J., Müller, M., & Klapuri, A. (Aug. 2010). State of the Art Report: Audio-Based Music Structure Analysis. In ISMIR (pp. 625-636).

Peeters, G., & Bisot, V. (Oct. 2014). Improving Music Structure Segmentation using lag-priors. In ISMIR (pp. 337-342).

Serra, J., Müller, M., Grosche, P., & Arcos, J. L. (2014). Unsupervised music structure annotation by time series structure features and segment similarity. IEEE Transactions on Multimedia, 16(5), 1229-1240.

Surges, G., & Dubnov, S. (Oct. 2013). Feature selection and composition using pyoracle. In Ninth Artificial Intelligence and Interactive Digital Entertainment Conference (p. 19).

Tian, M., Fazekas, G., Black, D. A., & Sandler, M. (Apr. 2015). On the use of the tempogram to describe audio content and its application to music structural segmentation. In Acoustics, Speech and Signal Processing (ICASSP), 2015 IEEE International Conference on (pp. 419-423). IEEE.

Wang, C. I., & Dubnov, S. (Sep. 2014). Guided music synthesis with variable markov oracle. In Tenth Artificial Intelligence and Interactive Digital Entertainment Conference.

Wang, C. I., & Dubnov, S. (Dec. 2014). Variable markov oracle: A novel sequential data points clustering algorithm with application to 3d gesture query-matching. In Multimedia (ISM), 2014 IEEE International Symposium on (pp. 215-222). IEEE.

Wang, C. I., & Dubnov, S. (Apr. 2015). Pattern discovery from audio recordings by variable markov oracle: A music information dynamics approach. In Acoustics, Speech and Signal Processing (ICASSP), 2015 IEEE International Conference on (pp. 683-687). IEEE.

FIG. 8A.
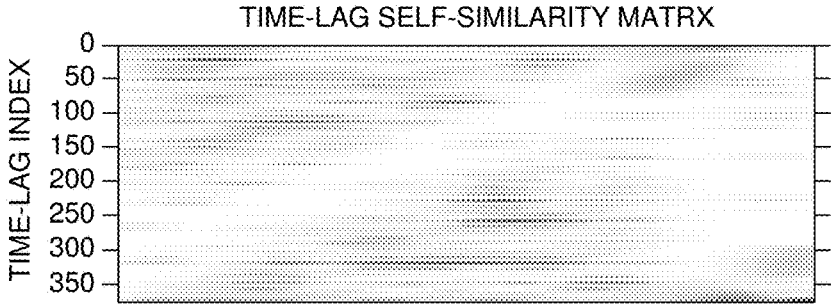
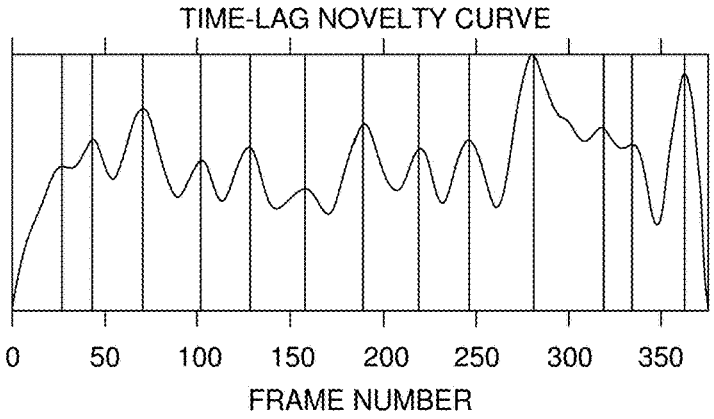
FIG. 8B.
FIG. 8C.
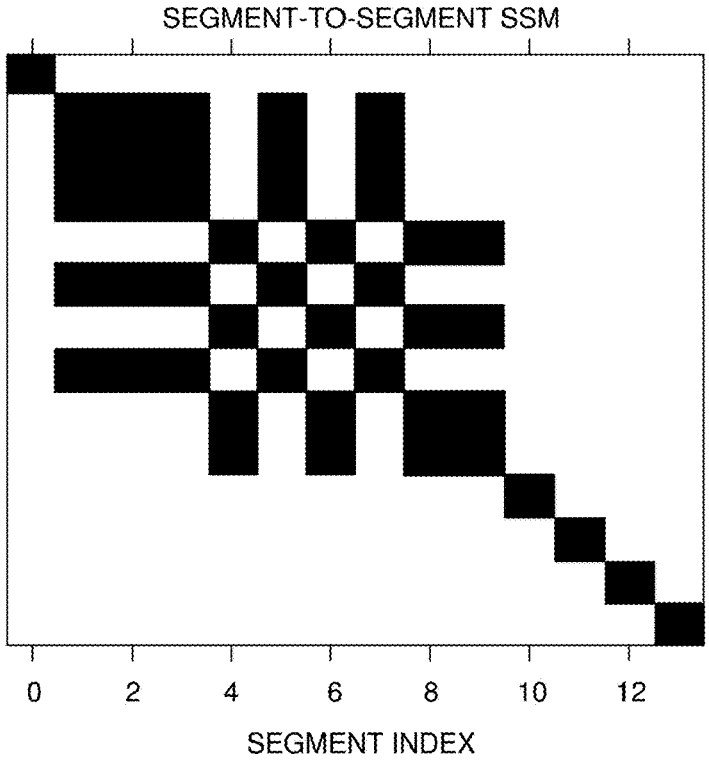

INTUITIVE MUSIC VISUALIZATION USING EFFICIENT STRUCTURAL SEGMENTATION

CROSS-REFERENCE TO RELATED APPLICATIONS

This application is a Continuation of U.S. patent application Ser. No. 14/948,695, filed Nov. 23, 2015 and entitled INTUITIVE MUSIC VISULIZATION USING EFFICIENT STRUCTURAL SEGMENTATION, the entirety of which is herein incorporated by reference.

BACKGROUND

Structure segmentation in music is useful when it is desired to understand the repeating structures in a music stream and where these repeating structures occur. A self-similarity matrix (SSM) and a recurrence plot are known as core elements for music structure segmentation. For instance, matrix decomposition methods have been applied to an SSM to obtain spectral features describing the structure of music. However, these traditional structure segmentation methods are computationally intense and costly.

In response to advancements of personal computing devices, including increases in storage space and computing speeds, many users are able to perform music analysis on their own devices. However, because traditional methods of structure segmentation are computationally intense and costly, practical deployment opportunities on personal computing devices are limited. Thus, users may not have access to systems that can generate hierarchical structures, which are used for music structure segmentation.

SUMMARY

Embodiments of the present invention are directed to methods and systems for providing a computationally efficient approach to structurally segment audio, and in particular, music. To reduce the computational requirements for structure segmentation for music, a pattern finding algorithm and/or a signal segmentation algorithm, such as Variable Markov Oracle (VMO), may be utilized. VMO is a suffix automaton capable of symbolizing a multi-variate time series, and which keeps track of repeated segments of the music. Initially, features may be extracted from an input waveform, such as a signal that represents a particular music stream. VMO is then applied to index the extracted features and to generate a VMO structure, from which a symbolic sequence may be extracted. A matrix, such as a VMO-SSM, is then constructed from the VMO structure. In some embodiments, a connectivity matrix is generated prior to the application of a segmentation algorithm. Once a segmentation is formed, the boundaries of the segments may be refined or adjusted iteratively, or until, for example, the number of frames moved during the boundary adjustment is below a predetermined number.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

The present invention is described in detail below with reference to the attached drawing figures, wherein:

FIG. 8A depicts a smoothed time-lag matrix from VMO-SSM, in accordance with embodiments of the present invention;

FIG. 8B depicts a time-lag novelty curve derived from the time-lag matrix of FIG. 8A, in accordance with embodiments of the present invention;

FIG. 8C depicts a segment-to-segment similarity matrix of "All You Need is Love" by the Beatles, in accordance with embodiments of the present invention;

DETAILED DESCRIPTION

Figure 1:
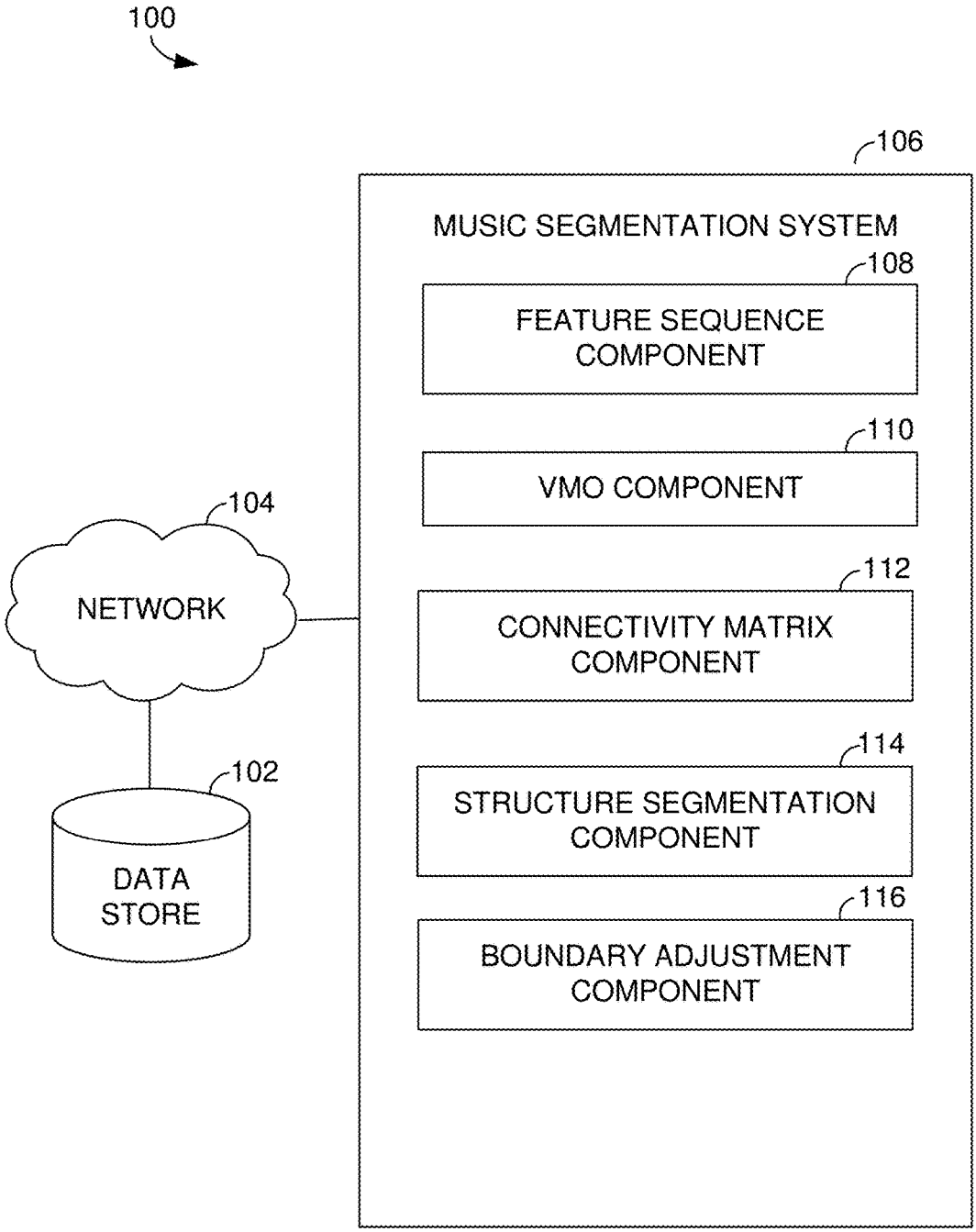
FIG. 1 is a block diagram of an exemplary computing system suitable for use in implementing embodiments of the present invention.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

Automatically recognizing the segmentation of a music piece is not only a fundamental task in music information retrieval research for music structure analysis, but also leads to the development of more efficient music content navigation and exploration mechanisms. Among various approaches, SSM has been the fundamental building block for several existing algorithms. An SSM captures global repetitive and homogenous structures and thus provides essential information for music segmentation. Matrix decomposition of SSM has been widely adopted in existing works. For example, non-negative matrix factorization (NMF) has been used to decompose SSM into basic functions representing different structural sections. The NMF idea has been extended with a convexity constraint on the weights during matrix decomposition, which leads to a more stable decomposition. Others have used ordinal linear discriminant analysis, which is used to learn feature representations from the singular value decomposition of the time-lag SSM. Spectral clustering techniques have been used to obtain a low-dimensional repetition representation from an SSM. Approaches have traditionally focused on deriving boundaries from SSM.

Approaches based on matrix decomposition or boundary detection represent two aspects of music segmentation problems, including finding global structures and local change points. The two problems also correspond to the categorization of repetition/homogeneous and a novelty-based approach.

To overcome some of the challenges presented by commonly used techniques for segmentation of music, including the two problems mentioned above, VMO is used in embodiments provided herein to obtain SSMs. Methods provided herein are based on VMO, which is a suffix automaton capable of symbolizing a multi-variate time series and is capable of keeping track of its repeated subsequences. Since repeating subsequences are essential in music structure analysis, using VMO to obtain an SSM has proven to work well for a music structure segmentation task, replacing the SSMs used in other prior approaches. Obtaining SSMs has traditionally been exhaustive, as frame-by-frame pairwise distances are calculated. Using VMO, however, overcomes the exhaustive computations previously needed to compute SSM without VMO.

Advantageously, use of VMO as the algorithm to create a matrix, such as an SSM, and even more particularly a VMO-SSM, over the more traditional frame-by-frame pair wise distance approach is that VMO is able to selectively choose frames with which to calculate distances based on if common suffices are shared between two frames. This selective behavior leads to a more efficient calculation than the traditional exhaustive manner ($O(T \log T)$) versus $O(T^2)$. VMO also has the capability to keep track of recurrent motifs within the time series. Even further, using VMO to calculate the SSM utilizes information dynamics to perform the reduction from a multivariate time series to a symbolic sequence. Information dynamics is aimed at modeling the evolving information dynamics as the time series unfolds from the perspective of information theory. In the case of VMO, Information Rate (IR) is maximized.

As mentioned, embodiments provided herein are directed to the use of VMO in segmentation computations of music. VMO is a suffix automaton and was originally devised for fast time-series query-matching and time-series motifs discovery. As set forth herein, VMO is used for music structure segmentation and indexing features sequences, which enables portions of the algorithm to be calculated more efficiently than has traditionally been done. One portion of music structure segmentation is the symbolization (dimension reduction) of the features sequence (multi-variate time sequence) into a generic symbolic sequence. Another portion is the fast retrieval of the SSM based on the suffix structure.

Figure 3:
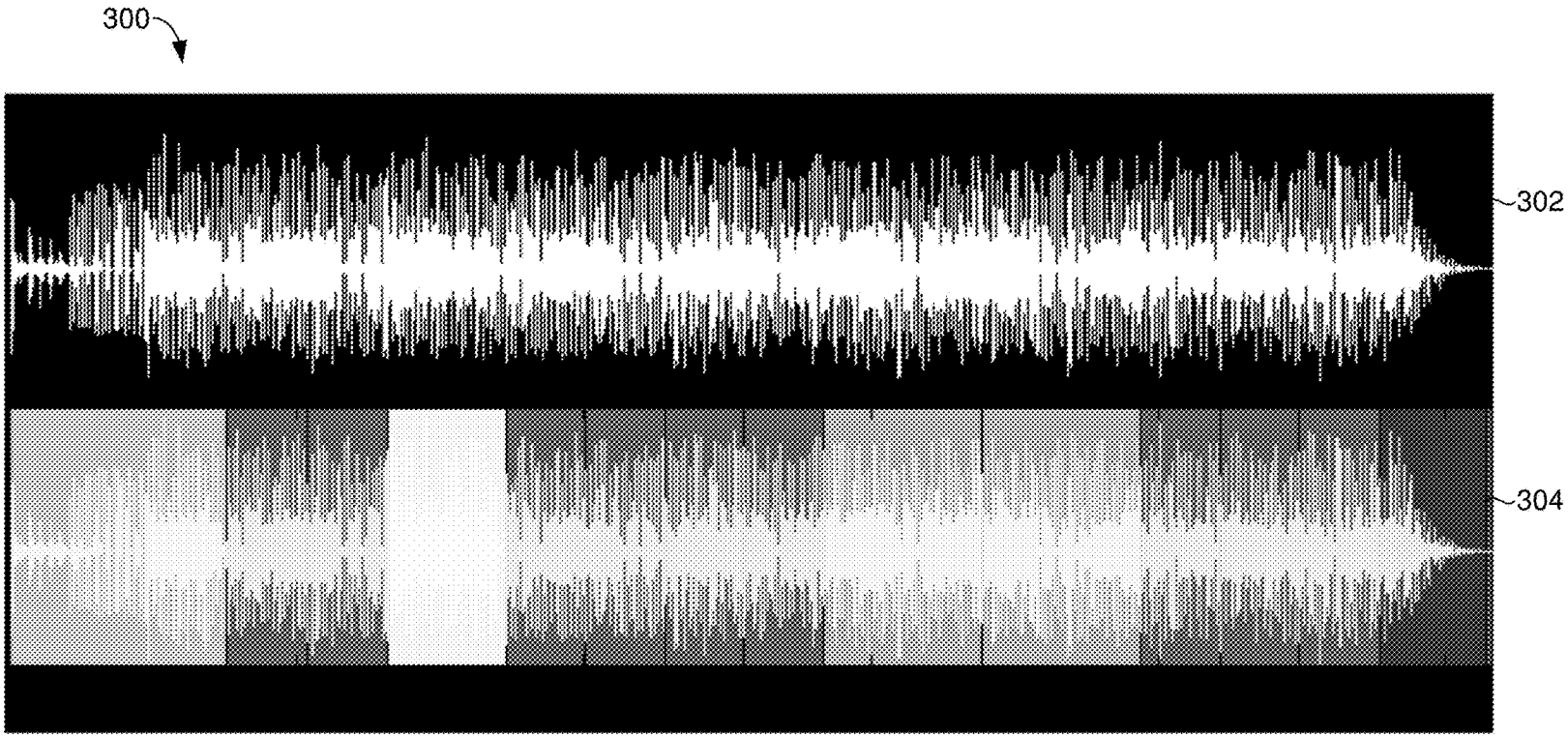
FIG. 3 depicts an illustration of an exemplary raw waveform and a segment structure, in accordance with an embodiment of the present invention.

In operation, and at a high level, a raw waveform, such as an input signal corresponding to a music stream, is the input for the system described herein. The waveform is transmitted to a feature sequence extractor, where a feature(s) is extracted from the waveform. These features may correspond to different music attributes from the raw waveform. The particular features extracted may depend on whether harmonic content, percussive content, or both, are present in the music. From the extracted features, a symbolized sequence is generated from a VMO structure. A matrix, such as a VMO-SSM, is then formed from the VMO structure. Several segmenting algorithms may be used for generating a segment structure from the VMO-SSM. For instance, spectral clustering, connectivity-constrained hierarchical clustering, or structure features and segment similarity may be used. The output of the system is thus a segmentation that visually indicates segments that are repetitive or homogenous. An example of a segmentation is illustrated in FIG. 3.

Having briefly described an overview of embodiments of the present invention, an exemplary operating environment in which embodiments of the present invention may be implemented is described below in order to provide a general context for various aspects of the present invention. Referring initially to FIG. 1 in particular, an exemplary operating environment for implementing embodiments of the present invention is shown and designated generally as environment 100.

The environment 100 of FIG. 1 includes a data store 102 and a music segmentation system 106. Each of the data store 102 and the music segmentation system 106 may be, or include, any type of computing device (or portion thereof), such as computing device 1100 described with reference to FIG. 11, for example. The components may communicate with each other via a network 104, which may include, without limitation, one or more local area networks (LANs) and/or wide area networks (WANs). Such networking environments are commonplace in offices, enterprise-wide computer networks, intranets, and the Internet. It should be understood that any number of data stores and components of the music segmentation system may be employed within the environment 100 within the scope of the present invention. Each may comprise a single device or multiple devices cooperating in a distributed environment. For instance, the music segmentation system 106 may be provided via multiple devices arranged in a distributed environment that collectively provide the functionality described herein. Additionally, other components not shown may also be included within the environment 100, while components shown in FIG. 1 may be omitted in some embodiments.

The data store 102 may be any type of computing device owned and/or operated by a user, company, agency, or any other entity capable of accessing network 104. For instance, the data store 102 may be a desktop computer, a laptop computer, a tablet computer, a mobile device, a server, or any other device capable of storing data and having network access. Generally, the data store 102 is employed to, among other things, store one or more audio streams, such as music streams. When it is desired to segment a particular music stream, that music stream can be retrieved from the data store 102 and communicated to the music segmentation system 106 by way of network 104.

The music segmentation system 106 comprises a feature sequence component 108, a VMO component 110, a connectivity matrix component 112, a structure segmentation component 114, and a boundary adjustment component 116. While these six components are illustrated in FIG. 1 and described with specificity herein, the music segmentation system 106 could have more or fewer components than these six. For instance, the functionality of two components may be combined into a single component, or could be divided into more than two individual components. As such, these six components are described herein for exemplary purposes only to describe the functionality of the music segmentation system 106.

The feature sequence component 108 is configured to extract features from the waveform corresponding to a music stream that is being analyzed. The features may correspond to different music attributes from the raw waveform. Features extracted may be determined based on whether harmonic content or rhythmic content is being analyzed. For harmonic content, constant-Q transformed (CQT) spectra, chroma, and Mel-frequency cepstral coefficients (MFCCs) may be extracted. CQT spectra is a remapping of the frequency bins in a short-time Fourier transform spectrum into logarithmic-spaced frequency axis, which corresponds to how different musical pitches are spaced. Chroma features may be obtained by folding CQT spectra along the frequency axis into one octave with twelve bins matched to the Western twelve equal temperament tunings. To obtain MFCCs, timbral characteristics are obtained (e.g., tone color, tone quality), as MFCCs can be used to represent timbral content at each sample point. MFCCs are discrete cosine transform coefficients of mel-spectrogram in decibels. For rhythmic content, features may be derived from a tempogram. A tempogram refers to a time-tempo representation that encodes the local tempo of a music signal over time.

In addition to the features mentioned above, other features, such as those described in various standards (e.g., MPEG-7 Audio) could be used as well. Combinations of the features mentioned herein and features described in veracious standards and elsewhere could also be extracted from a music source or other audio source.

Each feature frame is represented as a column vector and different features sampled at the same time point are concatenated vertically. A time-delay embedding is applied to stack the concatenated features with their neighboring frames. In embodiments herein, a neighbor number of three is used such that a feature frame at time t is vertically stacked with feature frames from time t−n to t+n, where n could equal any number. In embodiments n=1.

The VMO component 110 is configured to apply a VMO algorithm to generate a VMO structure, and then to generate a matrix, such as an SSM, and in particular a VMO-SSM. As previously mentioned, other systems used to segment music have not used an algorithm, such as VMO, that can be used to identify the symbolization (quantization) resolution so that the repeated structure of the time series is kept. As such, the use of VMO to automatically segment music, and also to provide labels and indicate similar segments, is described herein and is performed, at least, by the VMO component 110.

As used herein, VMO is a data structure that is capable of symbolizing a signal by clustering the feature frames in the signal, such as those derived from Factor Oracle (FO) and Audio Oracle (AO). In its data structure, VMO stores information regarding repeating subsequences within a time series via suffix links (i.e., backward pointer that links frame t to frame k, with t>k). For each observation at time i of the time series with length T indexed by VMO, a suffix link, sfx[i]=j, is created pointing back in time j to where the longest repeated suffix occurred. The suffix links not only contain the information regarding repeating sequences, but also imply a frame-to-frame equivalency between i and j given sfx[i]=j that leads to symbolization of the time series. Given the symbolized sequence S that is generated using VMO, a binary SSM (VMO-SSM), $R \in \mathbb{R}^{T\times T}$, may be obtained by way of Equation (1) below, with i>j, $$R_{ij} = \begin{cases} 1 & \text{if } sfx[i] = j, \\ 0 & \text{otherwise} \end{cases}, \qquad \text{Equation (1)}$$

and fill the main diagonal line with 1.

FO and AO are predecessors of VMO. FO is a variant of the suffix tree data structure devised for retrieving patterns from a symbolic sequence. AO is the signal extension of FO, and is capable of indexing repeated sub-clips of a signal sampled at a discrete time. AO is typically applied to audio query and machine improvisation. FO tracks the longest repeated suffix of every "letter" along a symbolic sequence by constructing an array, S, storing the position of where the longest repeated suffix happened, and a longest repeated suffix (lrs) array, and storing the length for the corresponding longest repeated suffix. AO extends FO by implicitly symbolizing each incoming observation of a multi-variate time series. VMO combines FO and AO in the sense that the symbolization of AO is made explicit in VMO. The explicit symbolization is done by assigning labels to the frames linked by suffix links. As a result, VMO is capable of symbolizing a signal by clustering the feature frames in the signal and keeping track of where and how long the longest repeated suffix is for each observation frame. Furthermore, the construction algorithm of the oracle structure is an incremental algorithm, thus making the oracle structure an appropriate option when real-time or short computation times are desired.

Figure 5A:
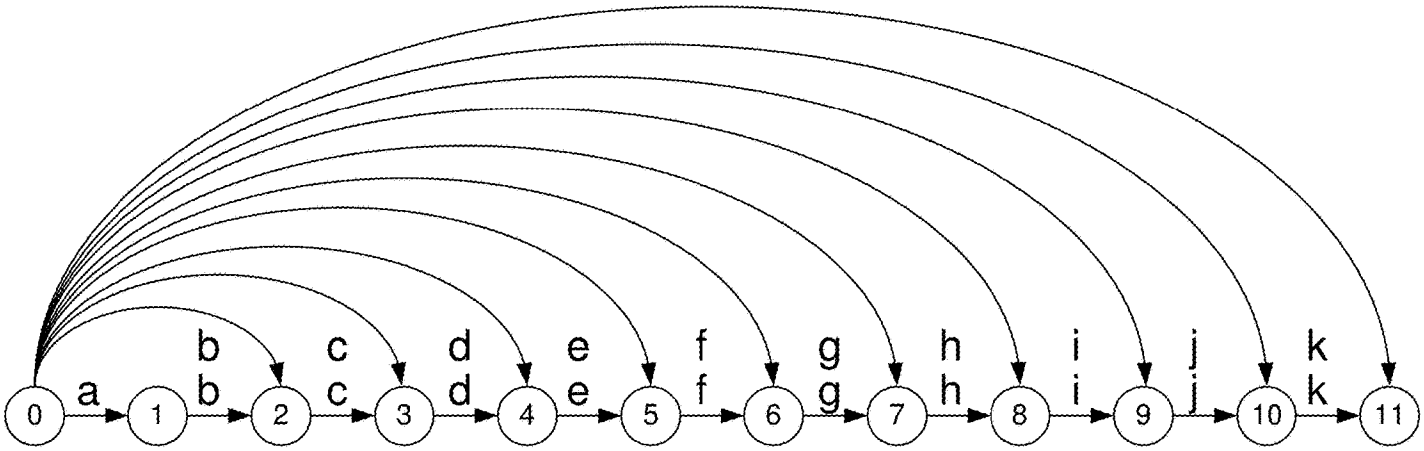
FIGS. 5A and 5B are exemplary oracle structures, in accordance with embodiments of the present invention.
Figure 5B:
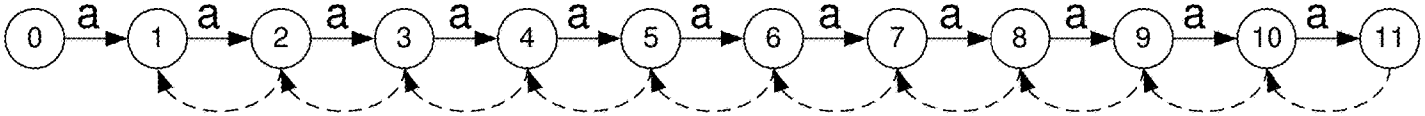

To symbolize an incoming observation, a threshold θ is used during the VMO construction algorithm. An incoming sample with distance (dissimilarity) less than θ to a previous sample along the suffix path would be considered being in the same cluster as the previous sample. To determine the value of θ, an information theoretic measure called Information Rate (IR) may be used. IR measures the predictability of the source of a time series by considering the mutual information between the present sample and all past observations. In practice, the conditional entropy embedded in the mutual information is untraceable unless a parametric probabilistic model is chosen to represent the source. For a complex and dynamic phenomenon such as music, parametric probabilistic models may only capture a single or very few surface dimensions of a music signal and may fall short of modeling the innate structure of such a music signal. With an FO data structure, the aforementioned problem could be solved by replacing the conditional entropy with a compression measure associated with an FO. Compror is a lossless compression algorithm based on the repeated suffixes and lrs (length of the longest repeated suffix at each frame) values stored in an FO. For VMO, different θ values lead to different symbolized signals. The IR values of each of the different symbolized signals may be calculated using Compror. In FIGS. 5A and 5B, oracle structures constructed by extreme κvalues are depicted, and will be described in more detail below.

Figure 4A:
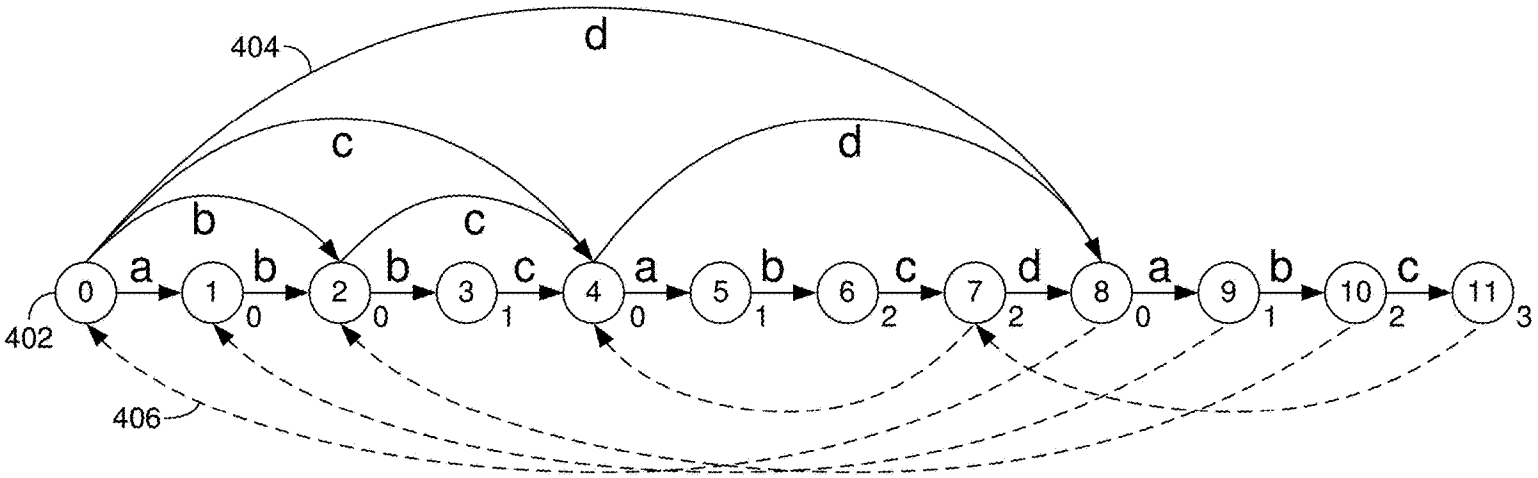
FIG. 4A depicts an exemplary VMO structure, in accordance with an embodiment of the present invention.
Figure 4B:
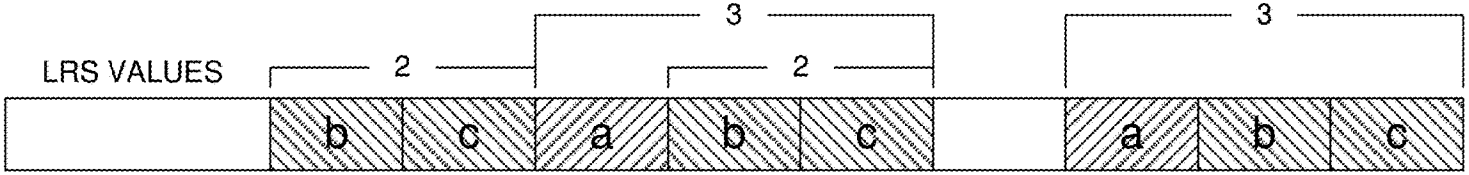
FIG. 4B is an exemplary visualization of repeated sections of the VMO structure of FIG. 4A, in accordance with an embodiment of the present invention.

FIGS. 4A and 4B illustrate exemplary VMO structures. The clusters of segments having the same label (i.e., b and b, a and a) formed by gathering states connected by suffix links have the following properties: 1) states connected by suffix links have distances less than θ; 2) labels are related to each other sequentially because frames symbolized by the same label share similar context by the use of suffix links; 3) each state is symbolized by one label since each state has only one suffix link; and 4) the alphabet size of the labels is not specified before the construction and is related to the threshold θ value.

Since VMO's data structure stores the length and positions of the repeated suffixes within a time series, a matrix can be constructed, such as a binary SSM from VMO, also referenced herein as VMO-SSM. For a symmetric matrix of size N×N, with N the number of frames, entries (i, j) and (j, i) are assigned the value 1 if S[i]=j, and assigned 0 otherwise.

As mentioned above herein, there are many advantages to using VMO to segment music. For instance, using VMO to calculate the SSM utilizes information dynamics to perform the reduction from a multivariate time series to a symbolic sequence. Information dynamics is aimed at modeling the evolving information dynamics as the time series unfolds itself from the perspective of information theory. In the case of VMO, Information Rate (IR) is maximized. For instance, let $x_1^N=\{x_1, x_2, \ldots, x_T$ denote time series x with T observations. In the equation below, which defines IR, H(x) is the entropy of x.

$$\mathrm{IR}(x_1^{t-1},x_t)=H(x_t)-H(x_t|x_1^{t-1}), \qquad \text{Equation (2)}$$

The connectivity matrix component 112 is configured to generate a connectivity matrix, which is constructed using median filtering and by the addition of local linkages. As used herein, R refers to a connectivity matrix prior to median filtering and the addition of local linkages. A median filter may be applied in the diagonal direction to suppress erroneous entries, fill missing blanks, and keep sharping edges of the diagonal stripes in the binary SSM. Equation (3) below illustrates a computation of a connectivity matrix with median filtering, represented by R'.

$$R'=\mathrm{median}(R_{i+j,j+t}|t\in-\omega,-\omega+1,\ldots,\omega). \qquad \text{Equation (3)}$$

The operation of adding local linkage may be defined as follows in Equation (4), wherein $R^+$ represents the connectivity matrix after the addition of local linkage:

$$\delta=\begin{cases}1 & \text{if } |i-j|=1\\ 0 & \text{otherwise}\end{cases}, \qquad \text{Equation (4)}$$

$$R_{ij}^{+}=\max(\delta_{ij}, R'_{ij}).$$

In Equation (5) below, I denotes an identity matrix with a dimension N, and D, the diagonal degree matrix of $R^+$. The symmetric normalized Laplacian matrix of $R^+$ is then calculated as:

$$L=I-D^{\frac{-1}{2}}R^{+}D^{\frac{-1}{2}}. \qquad \text{Equation (5)}$$

Figure 6:
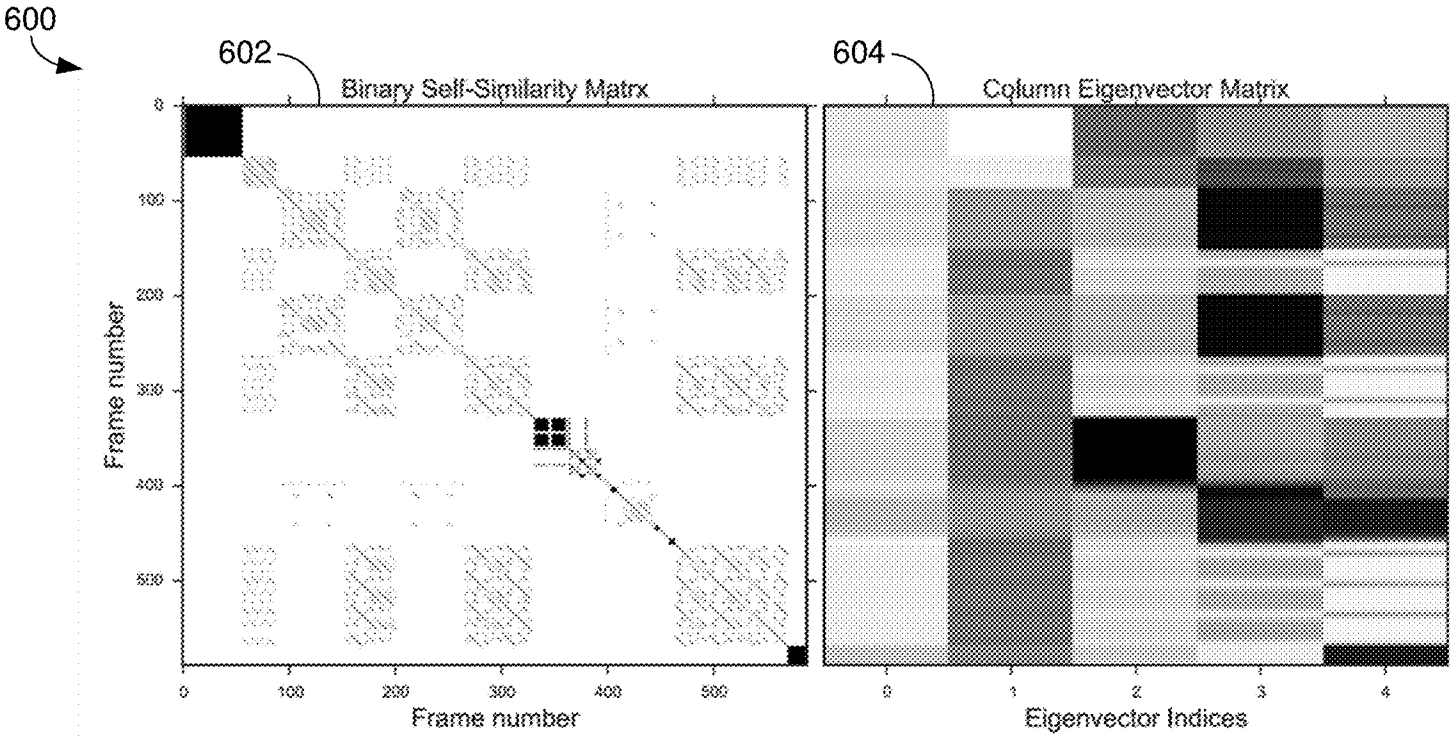
FIG. 6 depicts a binary SSM and an eigenvector matrix, in accordance with embodiments of the present invention.

FIG. 6 illustrates visualizations of $R^+$ and Y matrix, as discussed above. a binary SSM and a column eigenvector matrix. As used herein, an The structure segmentation component 114 is configured to generate a segment structure, which is a visual representation of a music stream divided into segments. In some embodiments, the segment structure produced may also include an indication of which segments are similar or repetitive to other segments. There are various segmentation algorithms that could be used to transform the VMO-SSM into a segment structure. The three methods of performing segmentation include spectral clustering, connectivity-constrained hierarchical clustering, and structure features and segment similarity.

Spectral clustering is a type of segmentation algorithm that may be used in embodiments herein to segment the music stream based on the other steps provided herein, including the use of VMO to generate a VMO-SSM. In instances where a connectivity matrix has been calculated from a feature sequence, and where k-means clustering has been applied to the rows of eigenvector matrix of the connectivity matrix to obtain segmentation boundaries and labels, spectral clustering is one option to obtain a segment structure. As used herein, k-means clustering is a method of vector quantization, originally from signal processing, that is popular for cluster analysis in data mining. For k-means clustering, k is set to be between about 4 and 6. The value of k is selected to maximize the entropy over the labels. Spectral clustering is applied on the connectivity matrix to obtain a low-dimensional representation of repetitive structures. The operations that could be utilized to obtain the connectivity matrix from the VMO-SSM and to apply spectral clustering include nearest neighbor thresholding, filtering with median filter, adding local linkages, balancing local and global linkage, linkage weighting, and feature fusion. It is noted that not all of these operations may be utilized for segmentation of a music stream. When segmentation is provided by spectral clustering, the first m eigenvectors with m smallest eigenvalues are concatenated to form a matrix $Y\in\mathbb{R}^{T\times m}$ with rows normalized. Each row of Y (eigenvector matrix illustrated as item 604 of FIG. 6) may be treated as one observation in k-means clustering with k=m. The assigned label from k-means clustering is the resulting segmentation label. Boundaries are inferred from finding label changes between adjacent frames. Visualizations of the $R^+$ matrix (connectivity matrix after median filtering and the addition of local linkage) and Y matrix (eigenvector matrix) are depicted in FIG. 6.

Connectivity-constrained hierarchical clustering is another method that may be used to segment music, according to embodiments herein. Connectivity-constrained hierarchical clustering is a computationally efficient algorithm that utilizes hierarchical clustering with connectivity constraints, and is commonly used to segment regions of an image. The connectivity constraint in the image segmentation task is neighboring relations between pixels. With the connectivity constraint, the hierarchical clustering works on the color values of each pixel, but is constrained to only merge neighboring pixels. For a music structure segmentation system, as provided herein, there are temporal neighboring relations along with suffix structures storing repetition information. The same information used in the spectral clustering approach to obtain the binary SSM is used in this approach as the connectivity constraint. During the connectivity-constrained hierarchical clustering, neighboring feature frames are merged to form larger sections and connected to distant regions by the constraint associated with suffix links to establish repetitive relationships among segments.

Yet another method to segment music according to embodiments herein is to use structure features (SF) and segment similarity. After obtaining the connectivity matrix (R) from VMO, as previously described, the following steps are applied to identify the boundaries: 1) a time-lag matrix L is obtained from R; 2) L is convolved with a 2-D Gaussian kernel; and 3) boundaries are identified via peak-picking on a novelty curve derived from L. To further obtain segment labels, segment-to-segment similarities are calculated based on a DTW-like (dynamic time warping) score given R. The resulting similarities are stored in a square matrix $\hat{S}$ with dimensions equal to the number of segments identified from boundary detection. A dynamic threshold based on the statistics of $\hat{S}$ is used to discard non-similar segments. Transitivity between similar segments is induced by iteratively applying matrix multiplication of $\hat{S}$ with itself and by thresholding. Segment labels are then obtained from the rows of $\hat{S}$. Parameters for this algorithm include the standard deviations of the Gaussian kernel, $\{S_L, S_T\}$, for time-lag and time axis, respectively, and peak-picking window length $\lambda$. An illustration of L (the Laplacian matrix of R+), the time-lag novelty curve, and $\hat{S}$ derived from R (segment-to-segment SSM) are illustrated in FIGS. 8A, 8B, and 8C herein.

The boundary adjustment component 116 is configured to adjust (e.g., refine) the boundaries of the segments provided for in the segment structure. In some embodiments, boundary adjustment may not be used. But in other embodiments, it may be more crucial that boundaries of a segment structure are adjusted, and thus boundary adjustment is applied to the segment structure. In one embodiment, the algorithm used for boundary adjustment is an iterative algorithm, and will be explained in more detail below.

In operation, once a segment structure has been created, the segmentation results may be observed, and may reveal that a segmentation algorithm is capable of locating the boundaries between segments within a window of a few seconds, but is not capable of locating the major change point within a window less than about one second. The reason might be due to the smoothing on the SSM to obtain R' or L. To remedy the aforementioned situation, an iterative boundary adjustment algorithm is proposed to fine-tune the segmentation boundaries to nearby local maxima in terms of the dissimilarity between adjacent segments. At a high level, the algorithm may randomly select a boundary to refine from the segment structure. Once selected, some or all of the boundaries in the segment structure are refined (e.g., moved in a direction by one or more frames). This process may be repeated until the total number of frames moved is less than a predetermined number, indicating that the boundaries are positioned in the correct place within the music stream.

An exemplary criterion that may be used to refine the boundaries in the segment structure is the distance between two adjacent segments. For instance, in one embodiment, this distance should be the farthest at the refined boundary points. The distance between two segments may be defined as the distance between the empirical distributions of the two segments. For exemplary purposes only, the Kullback-Leibler (K-L) divergence may be used to compute the distance between two segments, where the two segments are each modeled by a multinomial distribution. As the effect of changing one boundary point propagates to other adjacent segments of neighboring boundaries, an iterative algorithm is devised, as illustrated in Algorithm 1 below.

Algorithm 1 resembles an expectation-maximization algorithm in that each iteration stochastically cycles through all boundaries and adjusts them to maximize the K-L divergence of adjacent segments. Algorithm 1 then transforms the adjusted boundaries to new boundaries and proceeds to the next iteration until convergence criteria are met. In one embodiment, the stopping criteria include the total number of iterations N and the total length of boundaries moved C. Embodiments provide that the total length of a boundary moved during each iteration, c, monotonically decreases with a number of iterations i.

Algorithm 1 Iterative Boundary Adjustment

```
Require: Boundary points B (without beginning and ending frame),
    features X, window size W, iteration limit N and adjustment cost C.
n ← 0
while True do
  c ← 0
  B' ← B
  Randomly permute B'
  for b ∈ B' do
    κ ← K-L divergence of the two segments in X adjacent to b
    b' ← b
    for t ∈ {b − W : b + W} do
      κ' ← K-L divergence of the two segments in X adjacent to t
      if κ' > κ then
        κ ← κ'
        b' ← t
      end if
    end for
    b ← b'
    c += abs(b − b')
  end for
  B ← B'
  n += 1
  if c ≤ C||n ≥ N then
    break
  end if
end while
return B
```

It should be understood that this and other arrangements described herein are set forth only as examples. Other arrangements and elements (e.g., machines, interfaces, functions, orders, and groupings of functions, etc.) can be used in addition to or instead of those shown, and some elements may be omitted altogether. Further, many of the elements described herein are functional entities that may be implemented as discrete or distributed components or in conjunction with other components, and in any suitable combination and location. Various functions described herein as being performed by one or more entities may be carried out by hardware, firmware, and/or software. For instance, various functions may be carried out by a processor executing instructions stored in memory.

The components illustrated in FIG. 1 are exemplary in nature and in number and should not be construed as limiting. Any number of components may be employed to achieve the desired functionality within the scope of embodiments hereof. For example, any number of data stores or music segmentation systems may exist. Further, components may be located on any number of servers, computing devices, or the like. By way of example only, the music segmentation system 106 might reside on a server, cluster of servers, or a computing device remote from or integrated with one or more of the remaining components.

Figure 2:
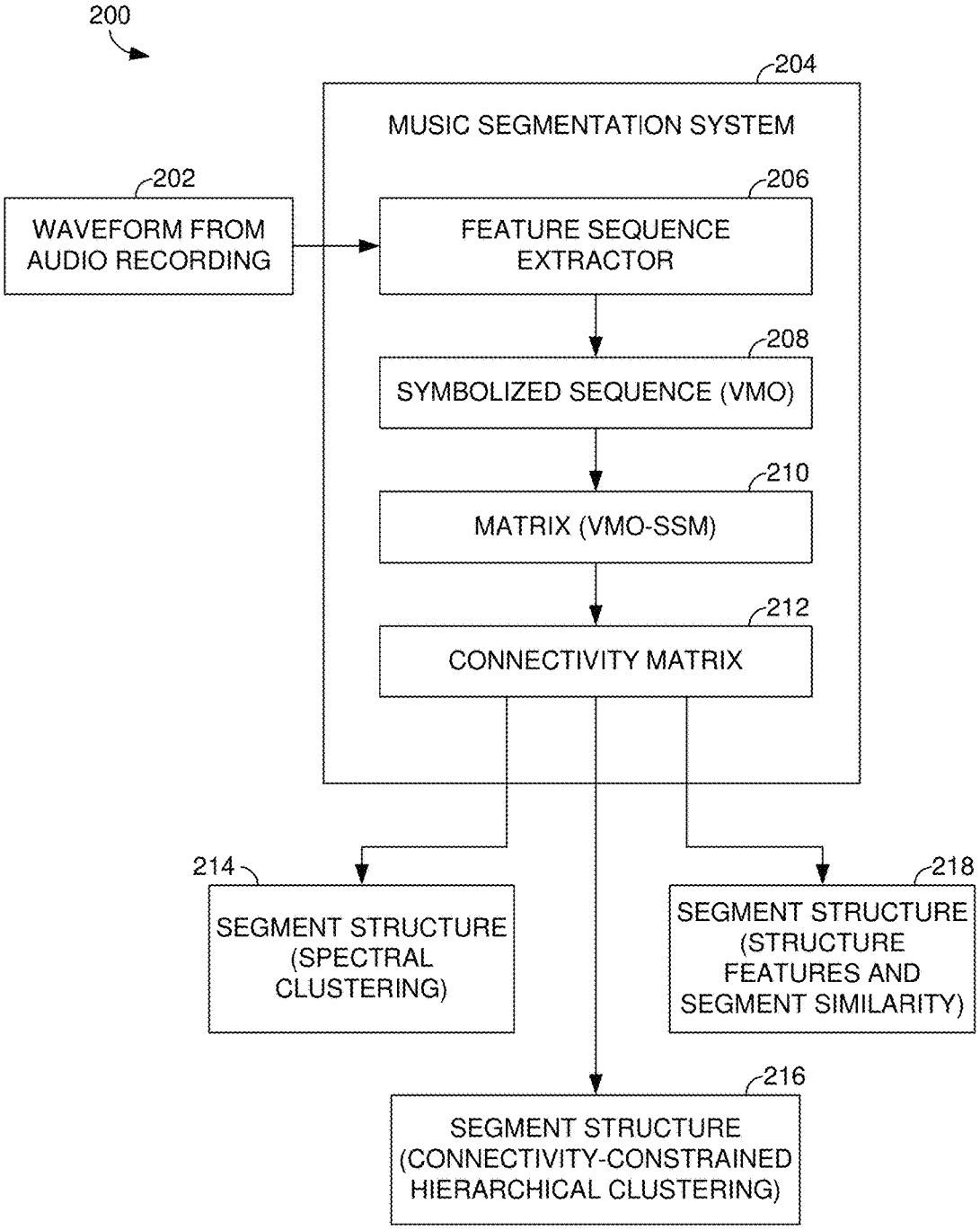
FIG. 2 is a block diagram of a system for automatically identifying structures of a music stream, in accordance with an embodiment of the present invention.

Turning now to FIG. 2, a block diagram 200 is provided of a system for automatically identifying structures of a music stream. While the contents of FIG. 2 have been described in relation to the components of FIG. 1, FIG. 2 provides a visual representation of how the input, such as the waveform from an audio recording 202, is processed and transformed into the output, a segment structure.

Initially, a waveform from an audio recording 202 is input into a music segmentation system 204. The music segmentation engine 204, as shown in FIG. 2, extracts features from the waveform by a feature sequence extractor 206. These features are used to generate a symbolized sequence 208, also termed a VMO structure. From the symbolized sequence 208, a matrix, such as a VMO-SSM matrix 210, is generated. In some embodiments, a connectivity matrix 212 is constructed from the VMO-SSM matrix 210. Once a connectivity matrix 212 is formed, a segment structure is generated. Three ways are provided in FIG. 2 for segmentation. A segment structure may be generated by way of spectral clustering 214. Or a segment structure may be generated by connectivity-constrained hierarchical clustering 216. Yet another way to generate a segment structure is by using structure features and segment similarity 218.

FIG. 3 is an illustration 300 of an exemplary raw waveform and a segment structure, in accordance with an embodiment of the present invention. The top portion of FIG. 3 labeled 302 is the raw waveform, where sections or parts of the waveform are unrecognizable by visual examination. The bottom portion of FIG. 3 labeled 304 illustrates the waveform having segments (e.g., verse, chorus, intro) visualized as color blocks on top of the raw waveform. In some embodiments, the same segment color indicates repetition of a segment.

Referring now to FIG. 4A, FIG. 4A depicts an exemplary VMO structure. The VMO structure includes a symbolized signal {a, b, b, c, a, b, c, d, a, b, c}. In this VMO structure, the upper solid arrows represent forward links 404 with labels for each frame. For a sequence of symbol $Q=q_1, q_2, \ldots, q_t, \ldots, q_T$, an FO structure is constructed with T frames, where each symbol $q_t$ is associated with a frame. There are two types of forward links in an oracle structure:

1) an internal link that is a pointer from state t−1 to t (labeled by the symbol qt), denoted by δ(t−1, qt)=t, and
2) an external link that is a pointer from state t to t+k (labeled by qt+k, where k>1).

An external link δ(t, qt+k)=t+k is created in FO when qt+1≠qt+k, qt=qt+k−1, and δ(t, qt+k)=Ø. As such, an external forward link is created when the most recent internal forward link is unseen for the previous occurrence of qt. The function of the forward links is to provide an efficient way to retrieve any of the factors of Q, starting from the beginning of Q and following a unique path formed by forward links.

The lower dashed arrows are suffix links 406, which are used to find repeated suffixes in Q. The symbols in $Q=q_1, q_2, \ldots, q_t, \ldots, q_T$ are formed by tracking suffix links along the frames in an oracle structure, such as an FO structure. Generally, a suffix link is a backward pointer that points from state t to k, where t>k. The link does not have a label and is denoted by sfx[t]=k. The condition for when a suffix link is created is sfx[t]=k⇔the longest repeated suffix of {q1, q2, . . . ,qt} is recognized in k.

The values located outside of each circle, which are the feature frames 402, are the lrs value for each state. For example, there is a suffix link from feature frame 11 to feature frame 7. The "3" outside of feature frame 11 indicates that the previous three symbols of the signal, {a, b, c}, are repeated and the suffix link points to where the repetition ended. FIG. 1 details how a VMO structure is generated, specifically in relation to the VMO component 110.

FIG. 4B is an exemplary visualization of repeated sections of the VMO structure of FIG. 4A. This visualization of repeated sections may be used as an alternative view of the symbolized signal structure of FIG. 4A. FIG. 4B illustrates how repeated sections {a, b, c} and {b, c} are related to lrs and sfx.

Turning to FIGS. 5A and 5B, exemplary VMO structures are depicted that have extreme values of θ. The characters near each forward link represent the assigned labels. FIG. 5A is an oracle structure with θ=0, or extremely low. FIG. 5B is an oracle structure with a very high θ value. In both cases, the oracles are not able to capture any structures of the time series. As mentioned above in regard to FIG. 1, and in particular the VMO component 110, a threshold θ is used during the VMO construction algorithm. An incoming sample with distance (dissimilarity) less than θ to a previous sample along the suffix path would be considered being in the same cluster as the previous sample. To determine the value of θ, an information theoretic measure called Information Rate (IR) may be used. IR measures the predictability of the source of a time series by considering the mutual information between the present sample and all past observations. In practice, the conditional entropy embedded in the mutual information is untraceable unless a parametric probabilistic model is chosen to represent the source. For a complex and dynamic phenomenon such as music, parametric probabilistic models may only capture a single or very few surface dimensions of a music signal and may fall short of modeling the innate structure of such a music signal. With an FO data structure, the aforementioned problem could be solved by replacing the conditional entropy with a compression measure associated with an FO. Compror is a lossless compression algorithm based on the repeated suffixes and lrs values stored in an FO. For VMO, different θ values lead to different symbolized signals. The IR values of each of the different symbolized signals may be calculated using Compror.

FIG. 6 depicts a binary SSM ($R^+$) 602 and an eigenvector matrix (Y) 604. Equations used to compute the binary SSM ($R^+$) are provided above, specifically in relation to the connectivity matrix component 112. In embodiments, the connectivity matrix R may be used to obtain R' and $R^+$ using one or more operations, including median filtering and adding local linkages, as described above. As mentioned herein in regard to FIG. 1, when segmentation is provided by spectral clustering, the first m eigenvectors with m smallest eigenvalues are concatenated to form a matrix $Y \in R^{T\times m}$ with rows normalized. Each row of Y (eignenvector matrix 604) may be treated as one observation in k-means clustering with k=m. As used herein, an eigenvector is a vector that does not change its direction under the associated linear transformation.

Figure 7A:
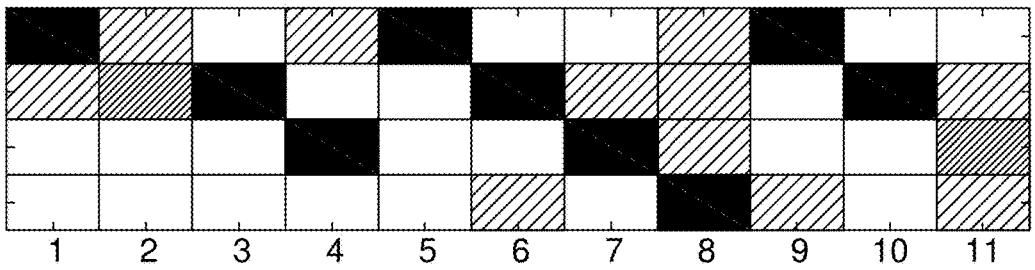
FIG. 7A depicts a synthetic 4-dimensional time series, in accordance with embodiments of the present invention.
Figure 7B:
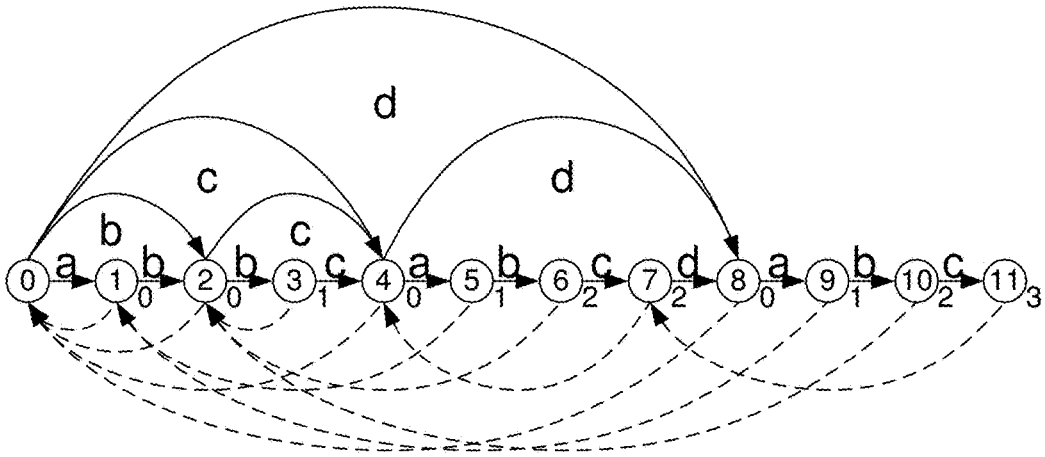
FIG. 7B depicts a VMO structure with symbolized signal, in accordance with embodiments of the present invention.
Figure 7C:
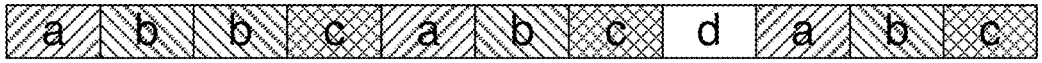
FIG. 7C depicts a symbolized signal, in accordance with embodiments of the present invention.
Figure 7D:
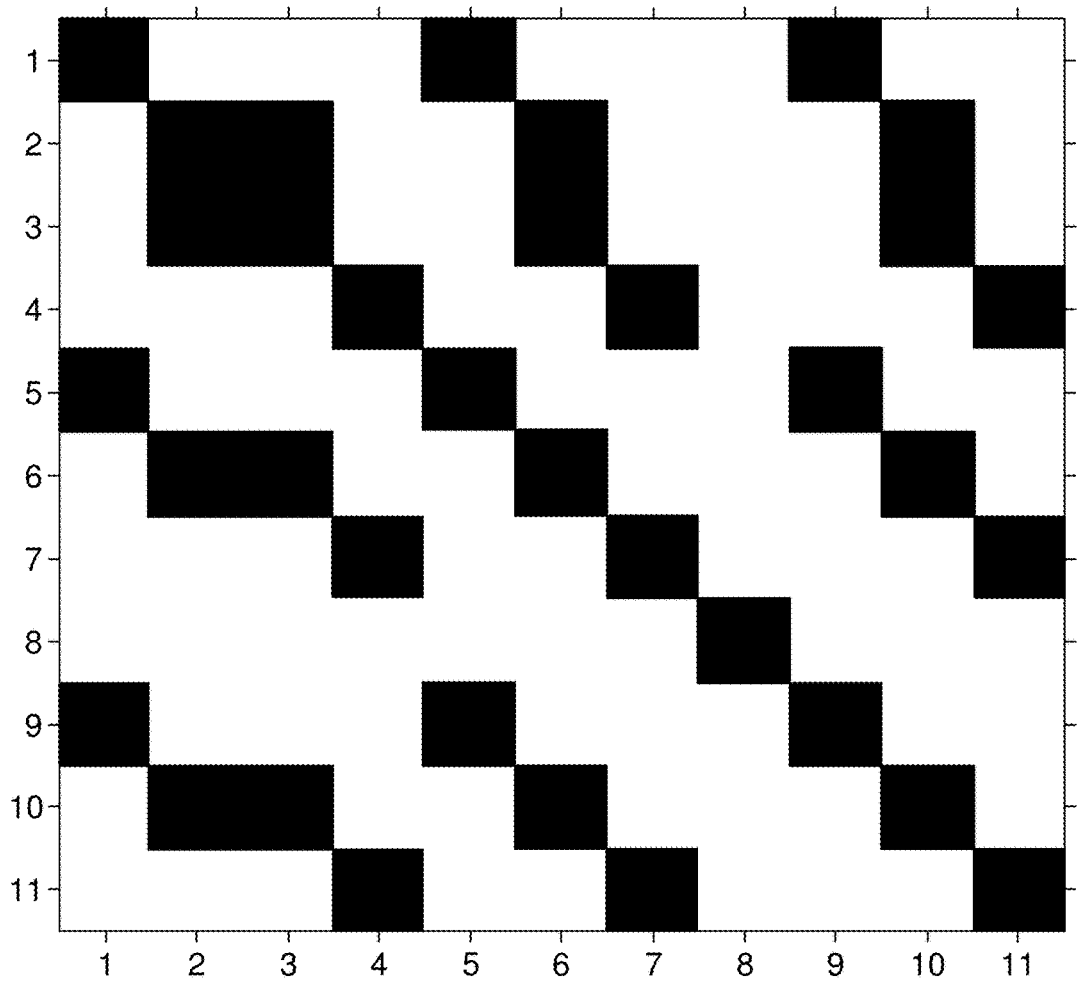
FIG. 7D illustrates a VMO-SSM obtained from the symbolized signal in FIG. 7C, in accordance with embodiments of the present invention.

FIGS. 7A-7D depict a visualization of how a VMO-SSM is obtained. FIG. 7A depicts a synthetic 4-dimensional time series, which may be a form of input. In an embodiment, a raw waveform may have been converted to a time series, such as that shown in FIG. 7A. From FIG. 7A, a VMO structure is generated with symbolized signal {a, b, b, c, a, b, c, d, a, b, c}, and having forward links (top) and suffix links (bottom). FIG. 7C depicts a symbolized signal, which may be a product or even an alternate view of the VMO structure of FIG. 7B. From the symbolized signal or the VMO structure, the VMO-SSM is created, shown in FIG. 7D.

FIG. 8A depicts a smoothed time-lag matrix L from VMO-SSM. FIG. 8B depicts a time-lag novelty curve derived from the time-lag matrix of FIG. 8A. FIG. 8C depicts a segment-to-segment similarity matrix $\hat{S}$ of "All You Need is Love" by the Beatles. These are produced when SF and segment similarity are used to provide segmentation. After obtaining R from VMO, as previously described, the following steps are applied to identify the boundaries: 1) a time-lag matrix L is obtained from R; 2) L is convolved with a 2-D Gaussian kernel; and 3) boundaries are identified via peak-picking on a novelty curve derived from L. To further obtain segment labels, segment-to-segment similarities are calculated based on a DTW-like (dynamic time warping) score given R. The resulting similarities are stored in a square matrix $\hat{S}$ with dimensions equal to the number of segments identified from boundary detection. A dynamic threshold based on the statistics of $\hat{S}$ is used to discard non-similar segments. Transitivity between similar segments is induced by iteratively applying matrix multiplication of $\hat{S}$ with itself and by thresholding. Segment labels are then obtained from the rows of $\hat{S}$.

Figure 9:
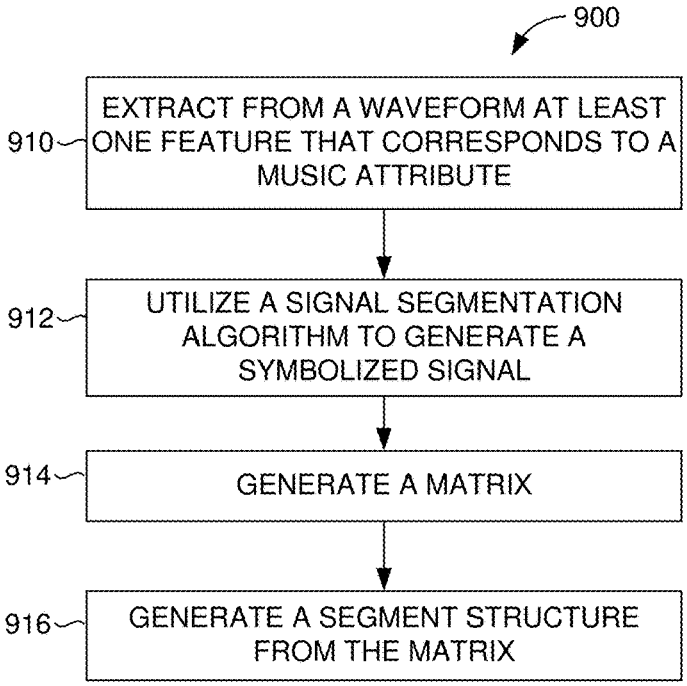
FIGS. 9 and 10 are flow diagrams illustrating methods for automatically identifying structures of a music stream, in accordance with embodiments of the present invention.

Turning now to FIG. 9, a flow diagram illustrating a method 900 for automatically identifying structures of a music stream is provided. Initially at block 910, features that correspond to a music attribute are extracted from a waveform. Extracted features may differ based on whether the content is harmonic or rhythmic. For example, for harmonic content of the music stream, features may be CQT spectra, chroma, or timbre (e.g., represented by MFCCs). For rhythmic content, the features may be derived from a tempogram. At block 912, a signal segmentation algorithm is utilized to generate a symbolized signal. In one embodiment, the signal segmentation algorithm is VMO. The symbolized signal may also referred to as a VMO structure. The VMO structure is a data structure capable of symbolizing a waveform by clustering observations in the waveform. The VMO algorithm, in generating the symbolized signal, may selectively choose frames for which to calculate a distance. This selective choosing may be based on whether common suffices are shared between two frames, which eliminates unnecessary computations. Even further, the VMO structure stores information corresponding to repeating sub-sequences within a time series by way of suffix links.

At block 914, a matrix is generated. In one embodiment, the matrix is an SSM, or more particularly, a VMO-SSM. A segment structure is generated from the matrix at block 916. The segment structure may indicate segments that are similar, such as by color coding, or other means of distinguishing one segment from another. When the segment structure is generated, one or more methods may be utilized. For instance, spectral clustering, connectivity-constrained hierarchical clustering, or structure features and segment similarity may be used for segmentation.

Figure 10:
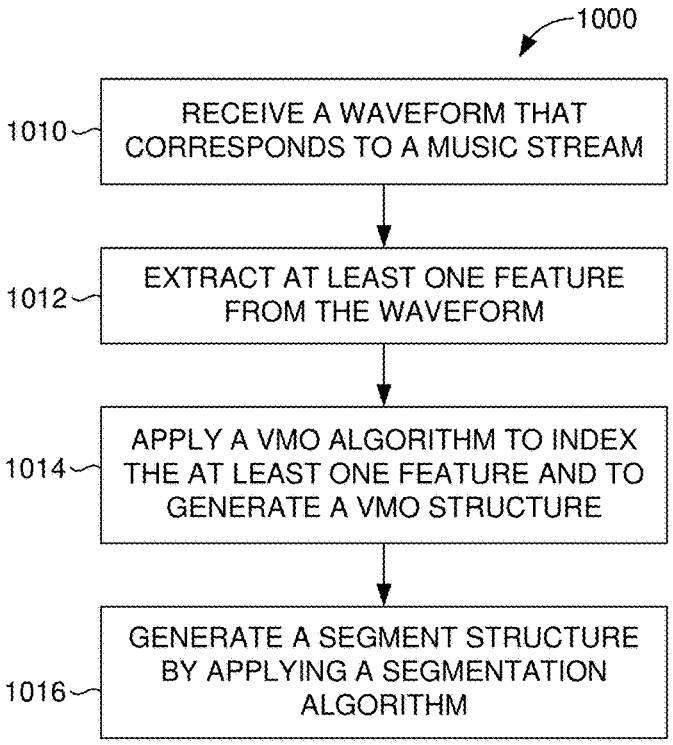

FIG. 10 illustrates another flow diagram illustrating a method 1000 for automatically identifying structures of a music stream. At block 1010, a waveform that corresponds to a music stream is received. The waveform may be received from, for example, data store 102 of FIG. 1, or any other source that may store a waveform. At block 1012, a feature may be extracted from the waveform. At block 1014, a VMO algorithm is applied to index the extracted feature and to generate a VMO structure. In some embodiments, a matrix, such as an SSM or a VMO-SSM is generated from the VMO structure. Even further, a connectivity matrix may be generated, the generation of which comprises median filtering, adding local linkages, etc.

At block 1016, a segment structure is generated by applying a segmentation algorithm. The segment structure indicates repetitive segments, such as by color coding or some other means of distinguishing one segment from another. Spectral clustering, connectivity-constrained hierarchical clustering, structure features and segment similarity, etc., may be used for segmentation and to generate a segment structure. In some embodiments, boundaries of the segment structure may be refined or otherwise adjusted by applying an iterative boundary adjusting algorithm to the segment structure, as discussed herein with respect to the boundary adjustment component 116 of FIG. 1.

EXAMPLE

An example is provided below to demonstrate the use of various algorithms, and each algorithm's result on segmentation and boundary refinement. In this example, the Beatles-ISO dataset comprising 179 annotated songs will be used. This example aims to identify a segmentation of a given audio recording and compare the segmentation with human annotations to determine the accuracy of the algorithms.

To evaluate the effect of the VMO-SSM and the boundary adjustment algorithm, the proposed framework is evaluated against the Beatles-ISO dataset and compared to existing algorithms on the same dataset. Three standard features and their combinations are considered in this experiment. These features include the CQT spectra, chroma, and MFCCs. All audio recordings are down-sampled to 22050 Hz, analyzed with a 93 ms window and 23 ms hop. CQTs are calculated between a frequency range of [0, 2093] Hz with 84 bins. Chroma is derived from CQT by folding the 8 octaves into 12 bins. MFCCs are calculated from 128 Mel bands and 12 MFCCs are taken. All features are beat-synchronized using a beat-tracker with median-aggregation. Features are then stacked using time-delay embedding with one step of history and one step of future. Each dimension of each feature is normalized along the time axis. To combine different features, the features are stacked. Different dimensions are assumed to have equal importance.

For this experiment, a parameter sweep was done to find the best combination of parameters. Cosine distance was used in the VMO distance calculation. For spectral clustering, the median filtering window w was 17. The number of different sections used for spectral clustering, m, was 5. For the SF algorithm used for segmenting, the standard deviations for time-lag and time axis, (sL, sT), were 0.5 and 12. The peak-picking window length $\lambda$ was 9. The parameters for the boundary adjustment algorithm, W, N, and C, were $\{4, 10, 2\}$, respectively.

The evaluation results of the proposed framework along with the ones from other existing works are shown in Table 1 below. The metrics used follow those proposed in the Music Information Retrieval Evaluation eXchange (MIREX). The evaluation can be described in two layers. The first layer is the performance on retrieving boundaries and the second layer is the performance on assigning labels to regions defined by retrieved boundaries. For boundary hit rate, the combination of VMO, spectral clustering, and boundary adjustment outperforms all other existing works by a margin of at least 7% in a 0.5 second window tolerance. For a 3 second window tolerance, despite being inferior to SF, the approaches with VMO-SSM are still superior to other existing methods. The boundary adjustment algorithm introduces a trade-off between short-time and long-time tolerance boundary hit rate. For spectral clustering, the trade-off of $F_{0.5}$ and $F_3$ is acceptable with $F_{0.5}$ improving slightly more than the degradation of $F_3$. It may be observed that applying the boundary adjustment algorithm on SF does not produce results that are as precise as other methods, as the degradation of $F_3$ is far more than the improvement on $F_{0.5}$. The discrepancy between applying the boundary adjustment algorithm on spectral clustering and SF may be understood by the nature of the segmentation algorithms. As SF focuses on finding boundaries from SSM more directly than the approaches utilizing matrix decomposition, there may not be much room for improvement of boundary accuracies in the post-processing stage. For segmentations, original SF ranks the highest in pair-wise clustering F-score, and the combination of VMO and SF ranks the next highest. For the F-score of normalized conditional entropy, the VMO-SF combination returns the highest score, and for matrix decomposition approaches, replacing traditional SSM with VMO-SSM achieves comparable or superior performances than existing works in segment labeling evaluation.

TABLE 1

| Algorithm | Boundaries | | | | | | Segmentations | | | | | |
|---|---|---|---|---|---|---|---|---|---|---|---|---|
| | $F_{0.5}$ | $P_{0.5}$ | $R_{0.5}$ | $F_3$ | $P_3$ | $R_3$ | $F_{pair}$ | $P_{pair}$ | $R_{pair}$ | $S_f$ | $S_c$ | $S_u$ |
| SF (Chroma) [8] | — | — | — | 77.4 | 75.3 | 81.6 | 71.1 | 78.7 | 68.1 | — | — | — |
| VMO + SF (Chroma) | 36.29 | 33.84 | 40.81 | 69.02 | 64.27 | 77.7 | 61.22 | 69.99 | 58.59 | 67.38 | 64.59 | 73.25 |
| VMO + SF* (Chroma) | 37.37 | 35.08 | 41.94 | 61.5 | 57.74 | 68.94 | 56.16 | 63.24 | 54.4 | 62.81 | 60.99 | 67.5 |
| VMO + SC (CQT + MFCC) | 34.34 | 29.38 | 43.52 | 64.46 | 55.09 | 81.64 | 55.9 | 68.63 | 49.87 | 62.50 | 57.59 | 70.54 |
| VMO + SC* (CQT + MFCC) | 38.41 | 34.28 | 45.47 | 60.98 | 54.29 | 72.26 | 52.84 | 61.08 | 49.05 | 60.02 | 55.87 | 64.84 |
| VMO + SC (Chroma) | 31.87 | 26.39 | 42.18 | 61.98 | 51.2 | 82.2 | 52.81 | 64.57 | 47.25 | 59.56 | 54.93 | 67.23 |
| VMO + SC* (Chroma) | 33.80 | 28.88 | 42.07 | 60.83 | 52.06 | 75.45 | 49.98 | 57.54 | 46.40 | 56.9 | 53.04 | 61.37 |
| SC [6] (CQT + MFCC) | 31.9 | 26.03 | 45.39 | 57.46 | 46.95 | 81.05 | 54 | 65.16 | 48.93 | 59.56 | 55.05 | 67.41 |
| C-NMF [4] (Chroma) | 24.89 | 24.52 | 26.41 | 60.41 | 59.84 | 63.45 | 53.53 | 58.29 | 52.65 | 57.2 | 55.85 | 60.63 |
| OLDA [5] (Multi-feature) | 29.6 | 29.7 | 32 | 53.5 | 55.3 | 55 | — | — | — | — | — | — |
| SI-PLCA[18] (Chroma) | 28.27 | 39.57 | 22.74 | 50.12 | 70.50 | 39.97 | 49.36 | 42.67 | 65.17 | 48.08 | 62.28 | 42.67 |
| CC [19] (Chroma) | 25.06 | 27.3 | 23.86 | 55.06 | 60.17 | 52.16 | 49.18 | 62.91 | 41.06 | 56.5 | 50.36 | 66.5 |

Having described an overview of embodiments of the present invention, an exemplary computing environment in which some embodiments of the present invention may be implemented is described below in order to provide a general context for various aspects of the present invention.

Embodiments of the invention may be described in the general context of computer code or machine-useable instructions, including computer-executable instructions such as program modules, being executed by a computer or other machine, such as a personal data assistant or other handheld device. Generally, program modules including routines, programs, objects, components, data structures, etc., refer to code that perform particular tasks or implement particular abstract data types. The invention may be practiced in a variety of system configurations, including hand held devices, consumer electronics, general-purpose computers, more specialty computing devices, etc. The invention may also be practiced in distributed computing environments where tasks are performed by remote-processing devices that are linked through a communications network.

Figure 11:
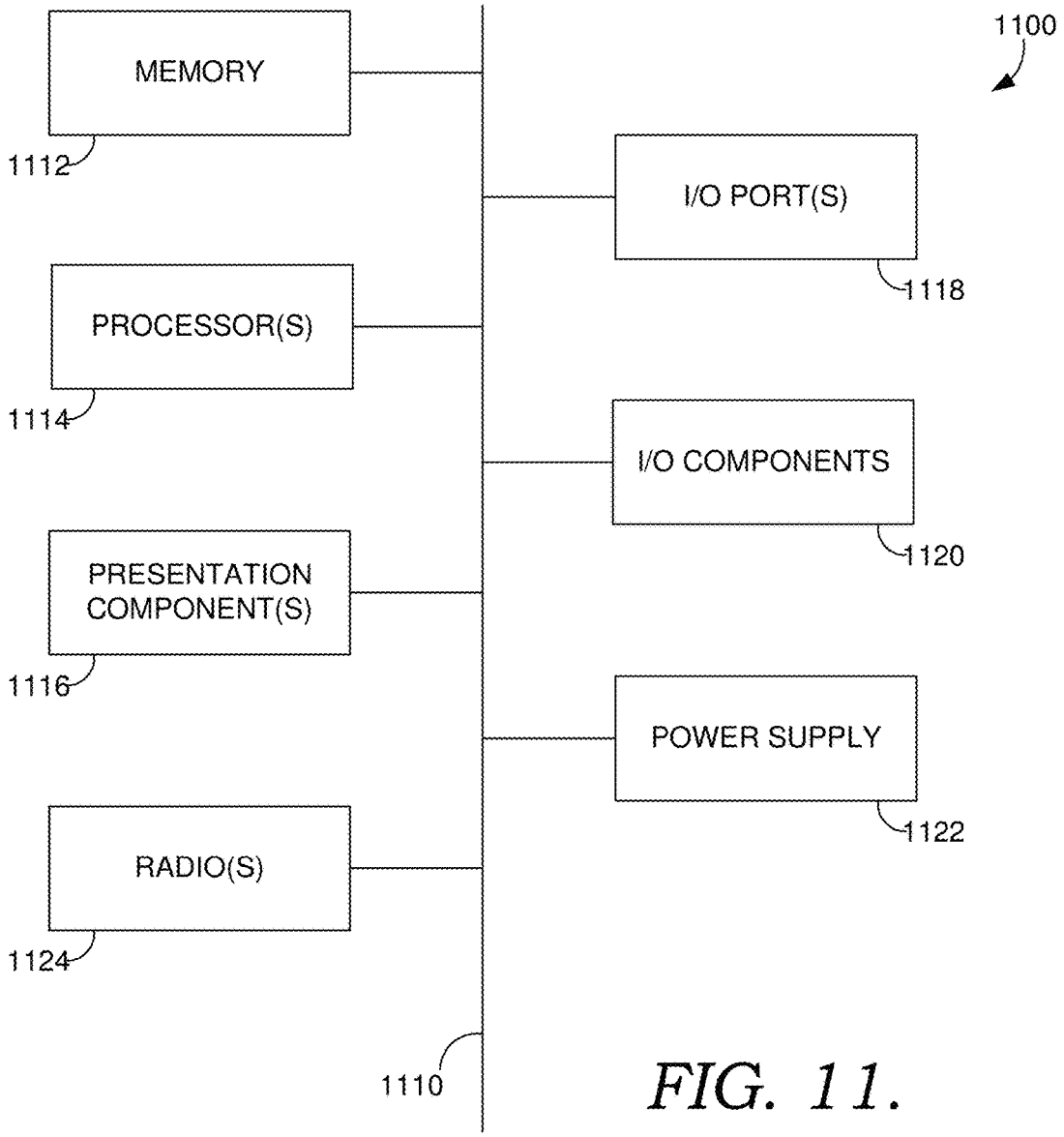
FIG. 11 is a block diagram of an exemplary computing environment in which embodiments of the invention may be employed.

Accordingly, referring generally to FIG. 11, an exemplary operating environment for implementing embodiments of the present invention is shown and designated generally as computing device 1100. Computing device 1100 is but one example of a suitable computing environment and is not intended to suggest any limitation as to the scope of use or functionality of the invention. Neither should the computing device 1100 be interpreted as having any dependency or requirement relating to any one or combination of components illustrated.

With reference to FIG. 11, computing device 1100 includes a bus 1110 that directly or indirectly couples the following devices: memory 1112, one or more processors 1114, one or more presentation components 1116, input/output (I/O) ports 1118, input/output (I/O) components 1120, and an illustrative power supply 1122. Bus 1110 represents what may be one or more busses (such as an address bus, data bus, or combination thereof). Although the various blocks of FIG. 11 are shown with lines for the sake of clarity, in reality, delineating various components is not so clear, and metaphorically, the lines would more accurately be grey and fuzzy. For example, one may consider a presentation component such as a display device to be an I/O component. Also, processors have memory. The inventors recognize that such is the nature of the art, and reiterate that the diagram of FIG. 11 is merely illustrative of an exemplary computing device that can be used in connection with one or more embodiments of the present invention. Distinction is not made between such categories as "workstation," "server," "laptop," "hand held device," etc., as all are contemplated within the scope of FIG. 11 and reference to "computing device."

Computing device 1100 typically includes a variety of computer-readable media. Computer-readable media can be any available media that can be accessed by computing device 1100 and includes both volatile and nonvolatile media, removable and non-removable media. By way of example, and not limitation, computer-readable media may comprise computer storage media and communication media. Computer storage media includes both volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computing device 1100. Computer storage media does not comprise signals per se. Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

Memory 1112 includes computer storage media in the form of volatile and/or nonvolatile memory. The memory may be removable, non-removable, or a combination thereof. Exemplary hardware devices include solid-state memory, hard drives, optical-disc drives, etc. Computing device 1100 includes one or more processors that read data from various entities such as memory 1112 or I/O components 1120. Presentation component(s) 1116 present data indications to a user or other device. Exemplary presentation components include a display device, speaker, printing component, vibrating component, etc.

I/O ports 1118 allow computing device 1100 to be logically coupled to other devices including I/O components 1120, some of which may be built in. Illustrative components include a microphone, joystick, game pad, satellite dish, scanner, printer, wireless device, etc. The I/O components 1120 may provide a natural user interface (NUI) that processes air gestures, voice, or other physiological inputs generated by a user. In some instances, inputs may be transmitted to an appropriate network element for further processing. An NUI may implement any combination of speech recognition, touch and stylus recognition, facial recognition, biometric recognition, gesture recognition both on screen and adjacent to the screen, air gestures, head and eye tracking, and touch recognition associated with displays on the computing device 1100. The computing device 1100 may be equipped with depth cameras, such as stereoscopic camera systems, infrared camera systems, RGB camera systems, and combinations of these for gesture detection and recognition. Additionally, the computing device 1100 may be equipped with accelerometers or gyroscopes that enable detection of motion. The output of the accelerometers or gyroscopes may be provided to the display of the computing device 1100 to render immersive augmented reality or virtual reality.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

What is claimed is:

1. A method for automatically identifying structures of an audio waveform that includes a plurality of frames, the method comprising:

generating a set of symbolized frames, from the plurality of frames, based on a feature of the plurality of frames;

determining an expression pattern of the feature based on a comparison of the set of symbolized frames to another set of symbolized frames;

segmenting the audio waveform into a plurality of waveform segments based on the determined expression pattern; and causing display of an indication of at least one of the plurality of waveform segments.

2. The method of claim 1, wherein generating a set of symbolized frames comprises utilizing a signal segmentation algorithm, which is utilized to generate a segmentation signal.

3. The method of claim 2, wherein the signal segmentation algorithm structure stores information corresponding to repeating sub-sequences within a time series by way of suffix links.

4. The method of claim 3, wherein the signal segmentation algorithm is utilized to generate a matrix, the matrix is a self-similarity matrix (SSM).

5. The method of claim 4, wherein the SSM is a signal segmentation algorithm-SSM.

6. The method of claim 1, wherein the segmenting the audio waveform utilizes one or more of spectral clustering, connectivity-constrained hierarchical clustering, or structure features and segment similarity.

7. The method of claim 1, wherein, for harmonic content of the audio waveform, the feature is one or more of a constant-Q transformed (CQT) spectra, a chroma, or timbre.

8. The method of claim 1, wherein, for rhythmic content of the audio waveform, the feature is derived from a tempogram.

9. The method of claim 8, wherein the timbre is represented by Mel-frequency cepstral coefficients (MFCCs).

10. The method of claim 2, wherein the symbolized signal is a signal segmentation algorithm structure, which is a data structure capable of symbolizing the waveform by clustering observations in the waveform.

11. The method of claim 2, wherein the signal segmentation algorithm is further used to symbolize the feature of the plurality of frames of the audio waveform and selectively choose frames or groups of frames for which to calculate a distance, the selectively choosing is based on whether common suffices are shared between two frames or two groups of frames, thereby eliminating unnecessary calculations.

12. The method of claim 1, wherein the audio waveform is a music stream.

13. One or more computer storage media storing computer-useable instructions that, when used by a computing device, cause the computing device to perform a method for automatically identifying structures of a music stream, the method comprising:

receiving a waveform that corresponds to the music stream;

extracting at least one feature from each of a plurality of frames of the waveform;

applying a signal segmentation algorithm to index the at least one feature for each of the plurality of frames;

comparing the indexed at least one feature for a set of frames to other sets of frames;

determining one or more segments of the waveform by applying a segmentation algorithm; and causing display of a visualization of the waveform that visually indicates the one or more segments of the waveform.

14. The one or more computer storage media of claim 13, further comprising generating a signal segmentation algorithm-SSM from a signal segmentation algorithm structure.

15. The one or more computer storage media of claim 13, further comprising generating a connectivity matrix from the signal segmentation algorithm-SSM, wherein generating the connectivity matrix comprises median filtering and adding local linkages.

16. The one or more computer storage media of claim 13, further comprising generating a segment structure, wherein the segment structure comprises an indication of repetitive segments.

17. The one or more computer storage media of claim 13, wherein the segmentation algorithm comprises one or more of spectral clustering, connectivity-constrained hierarchical clustering, or structure features and segment similarity.

18. The one or more computer storage media of claim 13, further comprising refining boundaries of the one or more segments of the waveform by applying an iterative boundary adjusting algorithm to the one or more segments of the waveform.

19. A system for automatically identifying structures of a music stream, the system comprising:

one or more processors; and one or more computer storage media comprising computer-useable instructions for causing the one or more processors to perform operations, the operations comprising:

extracting, from a waveform corresponding to the music stream, at least one feature that corresponds to a music attribute;

utilizing a signal segmentation algorithm to construct, from the at least one feature, a signal segmentation structure comprising a symbolized signal;

generating a signal segmentation algorithm-SSM matrix;

referencing the signal segmentation algorithm-SSM matrix to generate a segment structure, the segment structure illustrating a segmentation of the waveform; and causing display of a visualization of the segmentation of the waveform.

20. The system of claim 19, wherein the segment structure comprises an indication of repetitive segments.

* * * * *